US008242761B2

(12) United States Patent
Napravnik

(10) Patent No.: US 8,242,761 B2
(45) Date of Patent: Aug. 14, 2012

(54) LOW-DROPOUT LINEAR REGULATOR AND CORRESPONDING METHOD

(75) Inventor: Karel Napravnik, Prague (CZ)

(73) Assignee: STMicroelectronics Design and Application s.r.o., Praha (CZ)

( * ) Notice: Subject to any disclaimer, the term of this patent is extended or adjusted under 35 U.S.C. 154(b) by 378 days.

(21) Appl. No.: 12/621,273

(22) Filed: Nov. 18, 2009

(65) Prior Publication Data

US 2010/0148736 A1 Jun. 17, 2010

(30) Foreign Application Priority Data

Dec. 15, 2008 (IT) ..... TO2008A0934

(51) Int. Cl.
*G05F 1/00* (2006.01)

(52) U.S. Cl. ..... 323/280

(58) Field of Classification Search ..... 323/280, 323/276, 277, 273
See application file for complete search history.

(56) References Cited

U.S. PATENT DOCUMENTS

| | | | | |
|---|---|---|---|---|
| 5,274,323 | A | 12/1993 | Dobkin et al. | |
| 5,867,015 | A * | 2/1999 | Corsi et al. | 323/316 |
| 6,933,708 | B2 * | 8/2005 | Hamon et al. | 323/280 |
| 2002/0130646 | A1 | 9/2002 | Zadeh et al. | |
| 2004/0046532 | A1 | 3/2004 | Menegoli et al. | |
| 2004/0104711 | A1 | 6/2004 | Scones et al. | |

OTHER PUBLICATIONS

Italian Patent Office Written Opinion; Italy Application No. TO20080934, Jun. 12, 2009, 9 pages.

* cited by examiner

*Primary Examiner* — Shawn Riley
(74) *Attorney, Agent, or Firm* — Hogan Lovells US LLP

(57) ABSTRACT

A low-dropout linear regulator includes an error amplifier comprising a cascaded arrangement of a differential amplifier and a gain stage having interposed therebetween a frequency compensation network for a loading current to flow therethrough. The regulator includes a current limiter inserted the flow-path of the loading current for the compensation network to increase the slew rate of the output of the differential amplifier by dispensing with the capacitive load in the frequency compensation network during load transients in the regulator.

20 Claims, 2 Drawing Sheets

LOW-DROPOUT LINEAR REGULATOR AND CORRESPONDING METHOD

FIELD OF THE INVENTION

The present application claims priority of Italian Patent Application No. TO2008A000934 filed Dec. 15, 2008, which is incorporated herein in its entirety by this reference.

FIELD OF THE INVENTION

This disclosure relates to low-dropout linear regulators (LDOs). LDOs are used in a wide variety of applications in electronics to apply to a load a signal regulated as a function of a reference signal.

DESCRIPTION OF THE RELATED ART

The diagram of FIG. 1 is exemplary of the circuit layout of a conventional low-dropout linear regulator. The LDO of FIG. 1 is essentially comprised of a cascaded arrangement of an error amplifier 100 (in turn including a differential amplifier 102 receiving the reference signal VREF followed by a gain stage 104) and an output stage 106. The output stage 106 includes a Power MOS which receives from the gain stage 104 a voltage VGATE at its gate and applies an output voltage VOUT to a load including a resistive component Rload and a capacitive component Cload.

AN LDO as exemplified in FIG. 1 may use an adaptive bias 108 in the differential amplifier 102 in order to decrease quiescent current and consequently improve efficiency for low load currents. Frequency compensation elements (such as e.g. a RC stage including a resistor R1 and a capacitor C1) are usually connected to the output of the differential amplifier 102 (voltage VO1). In fact this is a high impedance node and the compensation is very effective.

Load transient response is a designation for the response of output voltage (VOUT) to rapid changes in the load current. Rapid changes in the load current may produces undershoots and overshoots in the output voltage VOUT.

SUMMARY OF THE INVENTION

An object of the present invention is to dispense with the undesired effects of rapid changes in a load current described above, it being noted that the claims are an integral part of the disclosure of the invention provided herein.

According to the present invention, such an object is achieved by means of a low-dropout linear regulator comprising (a) an error amplifier which includes a cascaded arrangement of a differential amplifier and a gain stage having a frequency compensation network interposed therebetween for a loading current to flow therethrough, and (b) a current limiter inserted the flow-path of the loading current for the compensation network.

In one embodiment, an improvement of load transient response of a low-dropout regulator (LDO) is provided based on slew rate increase of the differential amplifier output by dispensing with the capacitive load created by the frequency compensation elements.

In another embodiment, the present invention is used in LDOs with an adaptively biased differential pair.

A method of improving load transient response in a low-dropout linear regulator which includes an error amplifier having a cascaded arrangement of a differential amplifier and a gain stage having interposed therebetween a frequency compensation network with a capacitive load, the method includes increasing the slew rate of the output of said differential amplifier by dispensing with the capacitive load during load transients in the inear regulator.

BRIEF DESCRIPTION OF THE DRAWINGS

The invention will now be described, by way of example only, with reference to the enclosed views, wherein.

DETAILED DESCRIPTION OF EMBODIMENTS

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Figure 1:
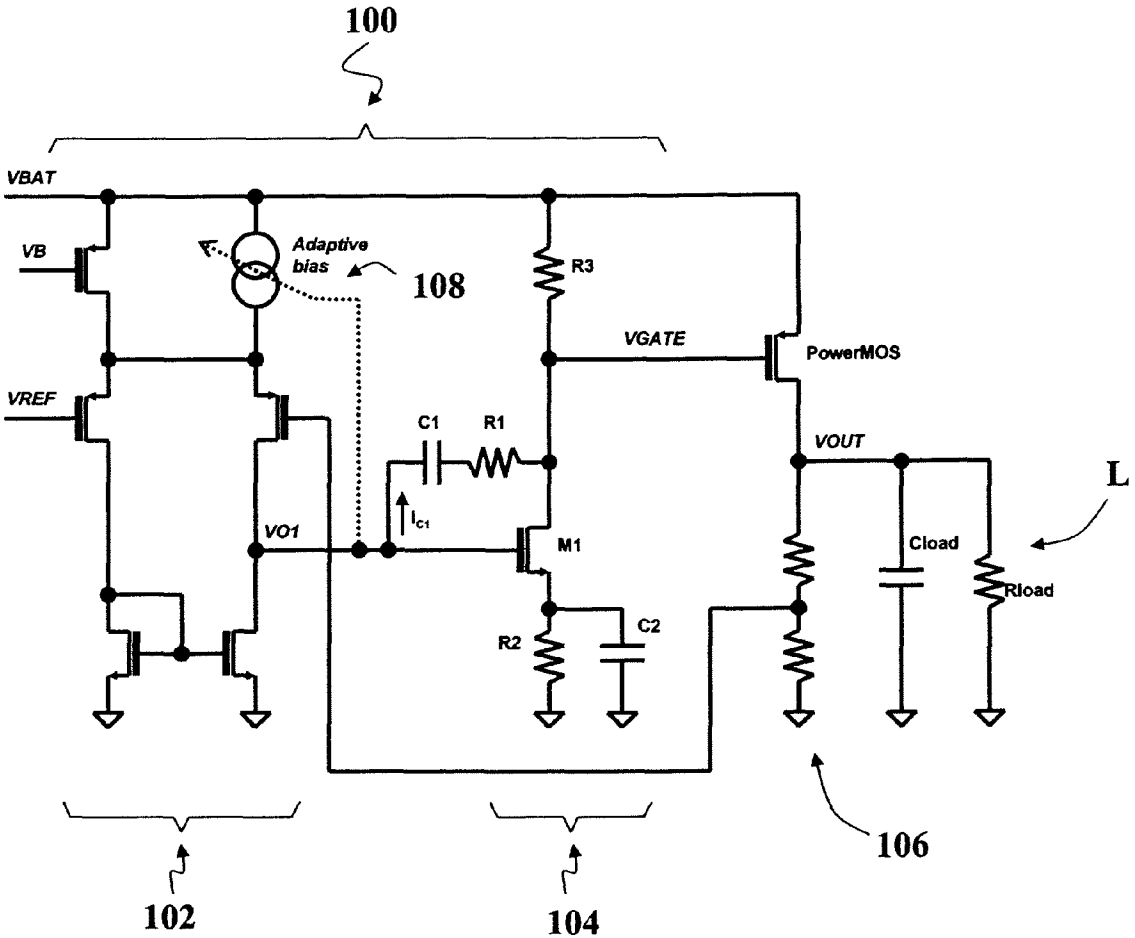
FIG. 1 has been already described in the foregoing.

The embodiment described herein is a proposed modification of the general layout of an LDO as illustrated in FIG. 1, consequently the detailed description of the embodiments described herein will not repeat those elements that are common with the arrangement of FIG. 1.

It will be otherwise understood that components/elements that are identical or equivalent are indicated with the same references.

Also, it will be appreciated that the embodiment described herein is applicable to any LDO layout including an error amplifier including a cascaded arrangement of a differential amplifier and a gain stage having interposed therebetween a frequency compensation network, irrespective of the constructional details of these amplifiers, stage and network. Referring to the constructional details of the LDO layout of FIG. 1 is thus merely for exemplary, non-limiting purposes.

The embodiment described herein is based on the recognition that a critical point for load transient response in an LDO as portrayed in FIG. 1 is the VO1 output node of the error amplifier 102.

The compensation capacitor C1 connected to this node is not assumed to create any dominant pole; its capacitance is thus selected at a very small value and has not a marked influence on the bandwidth of the regulator (in a small signal model). On the other hand, the capacitor C1 is charged by a current $I_{C1}$ drawn from the output of the differential amplifier 102 and this current is limited by the bias current of the adaptive bias 108. If the bias current is very small (a common situation if adaptive bias is used) then charging of the compensation capacitor C1 is very slow. As a result, the slew rate of the error amplifier 102 is reduced and the load transient response (large signal) is impaired.

Experimentally observing the load transient response of LDO with and without adaptive bias shows that undershoot in the output voltage is much larger in the case adaptive bias is present. This may be explained by noting that, because the LDO is in low bias current state before a transition in the output current $I_{OUT}$, then all responses of the regulator are slow. A more detailed analysis of undershoot shows that, after a transition in the output current $I_{OUT}$, the output voltage $V_{OUT}$ starts to decrease (the slope is determined by the values of $I_{OUT}$ and $C_{LOAD}$). The regulation error causes an increase in the output voltage VO1 of the differential amplifier 102, and the speed of this increase is limited by the bias current of the differential amplifier 102 that flows into the compensation capacitor $C_1$ ($I_{C1}$~$I_{BIAS}$~dVO1/dt). Since an LDO with adaptive bias starts with low bias current, the delay that appears on VO1 causes a larger undershoot.

The embodiment described herein leads to an improvement of load transient by increasing the slew rate of the output of differential amplifier 102. This can be achieved by dispensing with the influence on the output of differential amplifier 102 of the capacitive load created by frequency compensation elements. This operating principle is suitable especially for LDOs with adaptively biased differential pair.

It is possible to reduce the effect of the frequency compensation network during the time when the output voltage $V_{OUT}$ is out of desired range of values and the regulator is in state of large regulation error.

Figure 2:
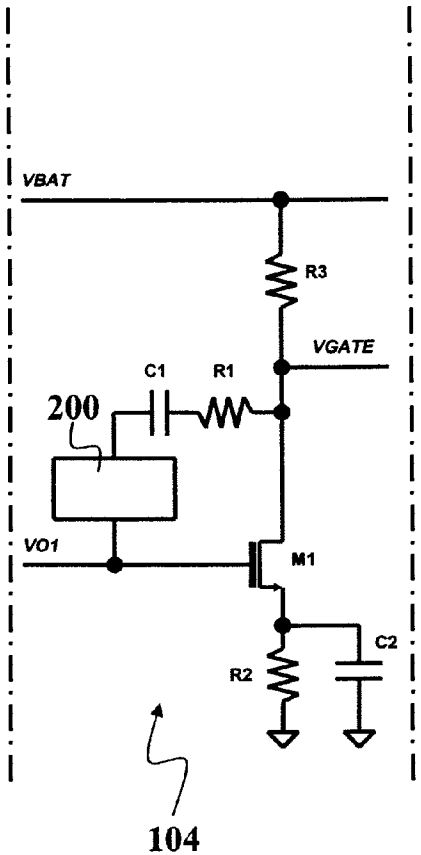
FIG. 2 is representative of a possible embodiment of the arrangement described herein, and FIG. 3 further details the embodiment of FIG. 2.

As illustrated in FIG. 2, this result can be obtained by inserting a current limiter 200 in the path of the load current $I_{C1}$ that flows through the frequency compensation network R1, C1. In that way, the compensation network R1, C1 will work normally with small signals but will in fact be disconnected for large signals.

During a load transient process (large signal) the output of the differential amplifier (i.e. the VO1 node) will be loaded only by a DC current defined by the current limiter 200 and by the input capacitance of the gain stage 104 (the MOSFET M1 in the exemplary embodiment considered here).

Experimental analysis of the resulting load transient response indicates that, with the arrangement of FIG. 2, the lower capacitive load at the output of the differential amplifier 102 allows VO1 to change much faster, while the current $I_{C1}$ into the compensation network, as determined by the current limiter 200, may be set to be much lower than the minimum bias current of the differential pair.

With the arrangement of FIG. 2, the capacitor C1 is charged by a low current, so that charging thereof takes a time longer that the recovery time after load transient. As a result, the compensation network R1, C1 is in fact kept inactive while the regulator is already in the minimum regulation error condition (with an otherwise negligible error on $V_{OUT}$ due to the offset of the differential amplifier 102 caused by the current load on VO1).

Any potential stability problems may however be overcome by charging C1 faster and bringing the compensation network R1, C1 into a normal state. This result can be achieved by using an adaptive current limiter to take into account that as the VO1 voltage and bias current increase, the VO1 node can be loaded by a higher current, thus speeding up the charging process of C1, so that the charging time of C1 can be effectively minimized while retaining the desired load transient performance.

Figure 3:
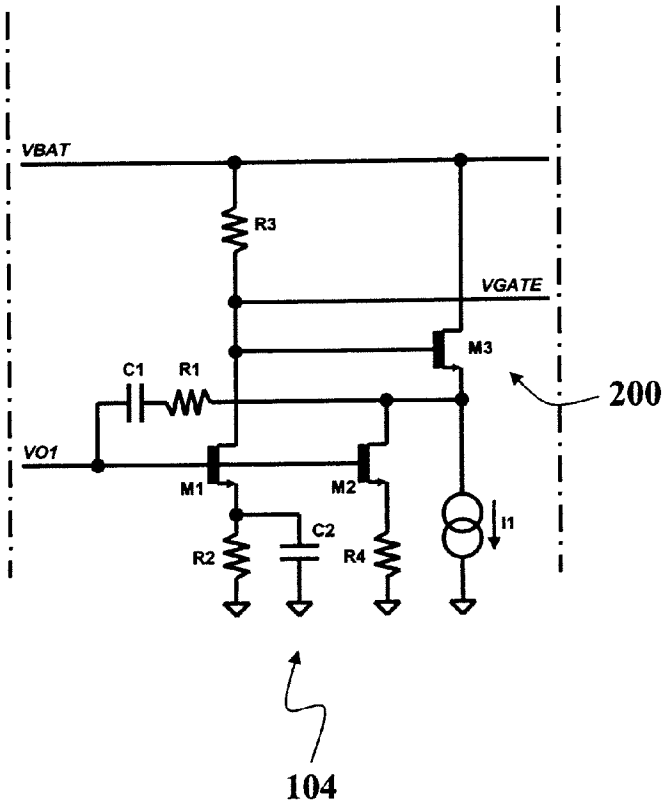

FIG. 3 (where elements/components identical or equivalent to those already described in connection with FIGS. 1 and 2 are indicated with the same references already appearing therein) is exemplary of an embodiment of such an adaptive current limiter. Essentially, in the embodiment of FIG. 3 a first MOSFET M2 is coupled in common gate arrangement with the MOSFET M1 of the gain stage 104 to perform the adaptive action (i.e. sensing the voltage and bias current increase at V01), while the MOSFET M3 operates as a buffer with limited output current capability that gradually "restores" the load current of the capacitor C1 as the VO1 voltage and bias current increase as sensed via the MOSFET M2 thus speeding up the charging process of C1.

Without prejudice to the underlying principles of the invention, the details and the embodiments may vary, even appreciably, with respect to what has been described by way of example only, without departing from the scope of the invention as defined by the annexed claims.

The invention claimed is:

1. A low-dropout linear regulator comprising:

an error amplifier including a cascaded arrangement of a differential amplifier and a gain stage having interposed therebetween a frequency compensation network for a loading current to flow therethrough; and a current limiter inserted in the flow-path of said loading current for said compensation network.

2. The regulator of claim 1, wherein said current limiter is configured to cause an output of said differential amplifier to be loaded during a load transient process on the regulator by a DC current defined by the current limiter and by the input of said gain stage.

3. The regulator of claim 1, wherein said current limiter comprises adaptive current limiter operative to increase said loading current for said compensation network as an output voltage of said differential amplifier increases.

4. The regulator of claim 3, wherein said adaptive current limiter includes:

a first transistor to sense the output voltage of said differential amplifier; and a second buffer transistor coupled to said first transistor to increase said loading current for said compensation network as the output voltage of said differential amplifier increases as sensed via said first transistor.

5. The regulator of claim 4, wherein said gain stage includes a gain transistor driven by the output of said differential amplifier, and said first transistor is coupled in a common gate arrangement with said gain transistor of said gain stage.

6. The regulator of claim 2, wherein said current limiter comprises an adaptive current limiter to increase said loading current for said compensation network as the output voltage of said differential amplifier increases.

7. The regulator of claim 6 wherein said adaptive current limiter includes:

a first transistor to sense the output voltage of said differential amplifier; and a second buffer transistor coupled to said first transistor to increase said loading current for said compensation network as the output voltage of said differential amplifier increases as sensed via said first transistor.

8. The regulator of claim 7, wherein said gain stage includes a gain transistor driven by the output of said differential amplifier, and said first transistor is coupled in a common gate arrangement with said gain transistor of said gain stage.

9. A method of improving load transient response in a low-dropout linear regulator including an error amplifier including a cascaded arrangement of a differential amplifier and a gain stage having interposed therebetween a frequency compensation network with a capacitive load in said frequency compensation network, the method including increasing the slew rate of the output of said differential amplifier by dispensing with said capacitive load in said frequency compensation network during load transients in said low-dropout linear regulator.

10. A low-dropout regulator comprising:

a differential amplifier having a first input for receiving a reference voltage, a second input, and an output;

a gain stage having an input coupled to the output of the differential amplifier, and an output;

a frequency compensation network coupled between the input of the gain stage and an intermediate node;

an output stage having an input coupled to the output of the gain stage, an output node for providing a regulated output voltage, and a feedback node coupled to the second input of the differential amplifier; and a current limiter having a first input coupled to the input of the gain stage, a second input coupled to the intermediate node, and a third input coupled to the output of the gain stage.

11. The low-dropout regulator of claim 10 wherein the gain stage comprises an N-channel transistor.

12. The low-dropout regulator of claim 10 wherein the frequency compensation network comprises a resistor in series with a capacitor.

13. The low-dropout regulator of claim 10 wherein the current limiter comprises:

a first transistor having a gate coupled to the input of the gain stage and a current path coupled between the intermediate node and ground;

a second transistor having a gate coupled to the output of the gain stage and a current path coupled between a source of supply voltage and the intermediate node; and a current source coupled between the intermediate node and ground.

14. The low-dropout regulator of claim 13 wherein the first transistor comprises an N-channel transistor.

15. The low-dropout regulator of claim 13 wherein the second transistor comprises an N-channel transistor.

16. The low-dropout regulator of claim 13 further comprising a resistor interposed into the current path of the first transistor.

17. The low-dropout regulator of claim 10 wherein the current limiter is further coupled between a source of supply voltage and ground.

18. The low-dropout regulator of claim 10 wherein the output stage comprises a P-channel transistor.

19. The low-dropout regulator of claim 10 wherein the output stage comprises a resistor divider that includes the feedback node.

20. The low-dropout regulator of claim 10 wherein the output stage comprises a load impedance.

* * * * *